US006698518B2

(12) United States Patent
Royer et al.

(10) Patent No.: US 6,698,518 B2
(45) Date of Patent: Mar. 2, 2004

(54) APPARATUS AND METHODS FOR USE OF A WELLSCREEN IN A WELLBORE

(75) Inventors: Ronnie Royer, Lafayette, LA (US); J. Eric Lauritzen, Kingwood, TX (US); Jeffery Bode, The Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/757,307

(22) Filed: Jan. 9, 2001

(65) Prior Publication Data

US 2002/0157836 A1 Oct. 31, 2002

(51) Int. Cl.[7] ..... E21B 43/04

(52) U.S. Cl. ..... 166/278; 166/51; 166/230; 166/233

(58) Field of Search ..... 166/278, 51, 228, 166/230, 232, 233

(56) References Cited

U.S. PATENT DOCUMENTS

| | | | | |
|---|---|---|---|---|
| 3,450,207 A | | 6/1969 | Hirsch | 166/233 |
| 3,712,373 A | | 1/1973 | Bearden et al. | 166/232 |
| 5,249,626 A | | 10/1993 | Gibbins | 166/235 |
| 5,307,984 A | * | 5/1994 | Nagaoka et al. | 228/189 |
| 5,476,143 A | | 12/1995 | Sparlin et al. | 166/233 |
| 5,515,915 A | | 5/1996 | Jones et al. | 166/51 |
| 5,829,522 A | * | 11/1998 | Ross et al. | 166/228 |
| 5,842,516 A | | 12/1998 | Jones | 166/56 |
| 5,881,809 A | * | 3/1999 | Gillespie et al. | 166/233 |
| 5,890,533 A | | 4/1999 | Jones | 166/51 |
| 6,158,510 A | * | 12/2000 | Bacon et al. | 166/272.7 |
| 6,227,303 B1 | * | 5/2001 | Jones | 166/378 |

FOREIGN PATENT DOCUMENTS

| | | | |
|---|---|---|---|
| WO | WO 00/61913 | 10/2000 | E21B/43/04 |
| WO | WO 01/14691 | 3/2001 | E21B/43/08 |

OTHER PUBLICATIONS

PCT Written Opinion, International Application No. PCT/GB02/00014, dated Oct. 16, 2002.

PCT International Search Report from International application No. PCT/GB02/00014, Dated Apr. 4, 2002.

* cited by examiner

*Primary Examiner*—Zakiya Walker
(74) *Attorney, Agent, or Firm*—Moser, Patterson & Sheridan, L.L.P.

(57) ABSTRACT

An apparatus and method for providing a more uniform gravel pack in the well bore. An alternative pathway is provided within the apparatus to by-pass a sand bridge formed in the wellbore. The reentry point of the slurry into the wellbore can be predetermined based upon the conditions of the formation.

12 Claims, 4 Drawing Sheets

APPARATUS AND METHODS FOR USE OF A WELLSCREEN IN A WELLBORE

BACKGROUND OF THE INVENTION

1. Field of the Invention

This invention relates to apparatus and methods for use in a wellbore to control the distribution of injected material in a wellbore. More particularly, the invention relates to methods and apparatus for providing a more uniform gravel pack in a wellbore.

2. Background of the Related Art

Hydrocarbon wells, especially those having horizontal wellbores, typically have sections of wellscreen comprising a perforated inner tube surrounded by a screen portion. The purpose of the screen is to block the flow of unwanted materials into the wellbore. Despite the wellscreen, some contaminants and other unwanted materials like sand, still enter the production tubing. The contaminants occur naturally and are also formed as part of the drilling process. As production fluids are recovered, the contaminants are also pumped out of the wellbore and retrieved at the surface of the well. By controlling and reducing the amount of contaminants that are pumped up to the surface, the production costs and valuable time associated with operating a hydrocarbon well will likewise be reduced.

One method of reducing the inflow of unwanted contaminants is through gravel packing. Normally, gravel packing involves the placement of gravel in an annular area formed between the screen portion of the wellscreen and the wellbore. In a gravel packing operation, a slurry of liquid, sand and gravel ("slurry") is pumped down the wellbore where it is redirected into the annular area with a cross-over tool. As the gravel fills the annulus, it becomes tightly packed and acts as an additional filtering layer along with the wellscreen to prevent collapse of the wellbore and to prevent the contaminants from entering the streams of production fluids pumped to the surface. Ideally, the gravel will be uniformly packed around the entire length of the wellscreen, completely filling the annulus. However, during gravel packing, the slurry may become less viscous due to loss of fluid into the surrounding formations or into the wellscreen. The loss of fluid causes sand bridges to form. Sand bridges are a wall bridging the annulus and interrupting the flow of the slurry, thereby preventing the annulus from completely filling with gravel.

The problem of sand bridges is illustrated in FIG. 1, which is a side view, partially in section of a horizontal wellbore with a wellscreen therein. The wellscreen 30 is positioned in the wellbore 14 adjacent a hydrocarbon bearing formation therearound. An annulus 16 is formed between the wellscreen 30 and the wellbore 14. The Figure illustrates the path of gravel 13 as it is pumped down the production tubing 11 in a slurry and into the annulus 16 through a crossover tool 33.

Also illustrated in FIG. 1 is a formation including an area of highly permeable material 15. The highly permeable area 15 can draw liquid from the slurry, thereby dehydrating the slurry. As the slurry dehydrates in the permeable area 15 of formation, the remaining solid particles form a sand bridge 20 and prevent further filling of the annulus 16 with gravel. As a result of the sand bridge, particles entering the wellbore from the formation are more likely to enter the production string and travel to the surface of the well. The particles may also travel at a high velocity, and therefore more likely to damage and abrade the wellscreen components.

In response to the sand-bridging problem, shunt tubes have been developed creating an alternative path for gravel around a sand bridge. According to this conventional solution, when a slurry of sand encounters a sand bridge, the slurry enters an apparatus and travels in a tube, thereby bypassing the sand bridge to reenter the annulus downstream. The shunt tubes may be placed on the outside of the apparatus or run along the interior thereof. However, there are problems associated with both designs. For example, by being outside of the apparatus, the shunt tubes are susceptible to breakage or deformation during construction or placement of the wellscreen in the wellbore. Additionally, since the shunt tubes are on the outside, the overall diameter of the production apparatus is increased, thereby decreasing the diameter of the annulus, and decreasing the filtering capabilities of packed gravel.

Shunt tubes located inside an apparatus are limited in their internal diameter and are generally constructed with little cross-sectional volume. Shunt tube-type devices also typically provide one location for slurry to enter and one location for slurry to exit. The entry and exit apertures cannot be easily relocated or adjusted for conditions of formations downhole because they are pre-manufactured. For example, when a sand bridge is by-passed using one of these conventional designs, the slurry reenters the annulus where the shunt tube exits the apparatus. As a result, the slurry may reenter the annulus adjacent the same highly permeable, formation causing the liquid portion of the slurry to be lost into the formation and more sand bridges to be formed as a result of the increased viscosity of the slurry.

There is a need therefore, for a wellscreen having an alternative pathway for injected material to by-pass sand bridges or other obstructions in a wellbore. There is a further need therefore, for a wellscreen that diverts the flow of a gravel slurry to the interior of the wellscreen and, thereafter, redirect the slurry to the exterior of the screen at a predetermined location along the wellbore. There is yet a further need for a wellscreen that controls the reentry of the slurry by decreasing, increasing or closing apertures formed in a wall of the wellscreen. There is a further need therefore, for a wellscreen for use with gravel packing operations that provides a bypass for slurry wherein the bypass provides a channel of greater volume than prior art devices. There is yet a further need for a wellscreen for use with a gravel packing operation wherein the openings of apertures are resistant to erosion by high velocity particles.

SUMMARY OF THE INVENTION

The present invention generally provides for an apparatus for use in a wellbore having an alternative pathway for a slurry to by-pass an obstruction such as a sand bridge during gravel packing.

In one aspect of the invention, an apparatus includes a perforated base pipe, a wire wrap around the perforated base pipe and an annular space therebetween providing an alternative pathway for a slurry to by-pass a sand bridge. At least one aperture is formed through the wire wrap to provide a path for slurry into the apparatus and at east one aperture is formed through the wire wrap to provide a path back out of the apparatus. Another aspect, an apparatus additionally includes a second wire wrap around the first wire wrap and forming a second annular space in the apparatus to provide an alternative pathway for a slurry to by-pass a sand bridge.

In another aspect, the invention provides a method to control and predetermine the optimal exit point for the slurry to reenter the annulus from the alternative pathway of the apparatus. The method comprises collecting information such as geological surveys and tests of the wellbore to determine the type of formations that would be encountered down hole during production; analyzing the information; adjusting the size and/or plugging up the apertures of the screen with inserts based upon the collected information, and adding protective inserts to the apertures if highly abrasive particles are present in the wellbore. In yet another aspect of the invention, the apparatus does not include a base-pipe but only two tubular-shaped wire wraps with an annular space formed therebetween.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
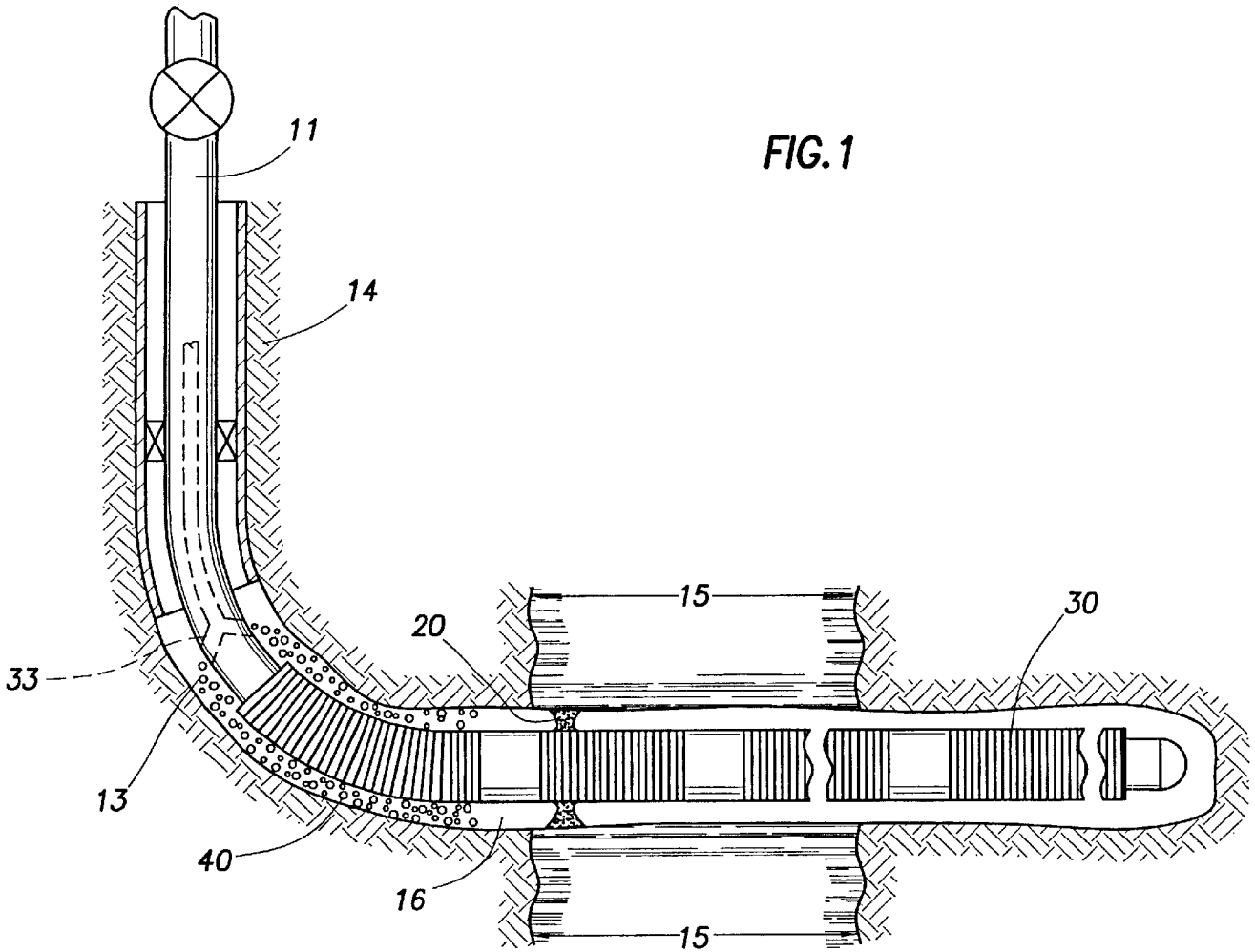
FIG. 1 is a side view, partially in section of a horizontal wellbore with a wellscreen therein.
Figure 3:
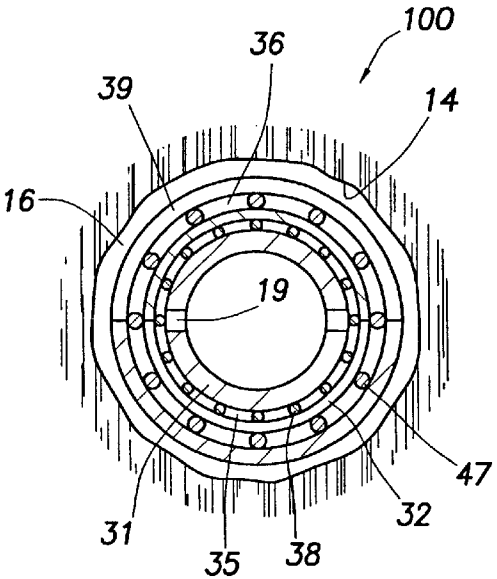
FIG. 3 is a cross-sectional view of the invention taken along line 3—3 of FIG. 2.
Figure 2:
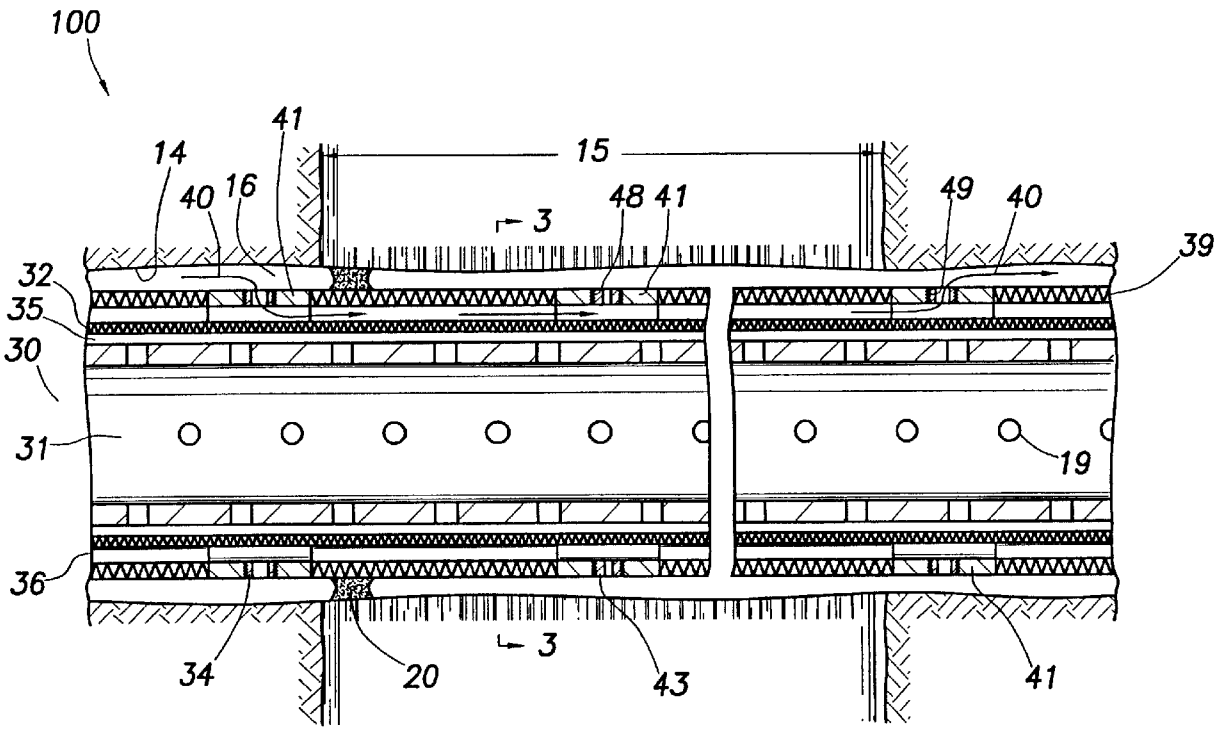
FIG. 2 is a side view of the present invention disposed in a wellbore.

FIG. 2 is a section view of an apparatus 100 according to the present invention disposed in a wellbore 14 and FIG. 3 is a cross-sectional view of the apparatus 100 taken along line 3—3 of FIG. 2. Although apparatus 100 is shown in a horizontal wellbore, the present invention can be utilized in any wellbore. In FIG. 2, the apparatus 100 is shown having collars 41 disposed between sequential sections of wellscreen 30. In this manner, the apparatus can be made up to any length by threading sections of wellscreen 30 together using collars 41 therebetween.

Wellscreen 30 includes a base pipe 31 having perforations 19 through the wall thereof. While the base pipe is perforated in the Figures shown, the base pipe may be slotted or include perforations of any shape so long as the perforations permit the passage of production fluid but inhibit the passage of particles. A first set of spacers 38, visible in FIG. 3, separate the perforated base pipe 31 from a first wire wrap 32 to create a first annular space 35 between the base pipe 31 and the first wire wrap 32. Additionally, the invention may be practiced without a base pipe so long as the wire wraps are arranged to provide an annular area therebetween and are resistant to collapse. A second set of spacers 47 separate the first wire wrap 32 from a second wire wrap 39 to create a second annular space 36 therebetween. The first and second wire wraps 32, 39 each may be made up of coil wires extending circumferentially around the base pipe 31. In the embodiment shown, the wire wraps are slightly spaced apart by spacers 38, 47 to permit production fluid to pass into the perforated base pipe 31, but also to prevent particles from entering the base pipe. In the embodiment of FIGS. 2 and 3, the second annular space 36 forms an alternative pathway through the apparatus. More specifically, the purpose of annulus 36 is to provide an alternative pathway for slurry through the apparatus when the annulus 16 between the apparatus 100 and the wellbore 14 is blocked by a sand bridge 20.

When the flow of slurry in annulus 16 is blocked by the presence of a sand bridge, the slurry enters the second annular space 36 through an entry aperture 34 formed in the wall of the wellscreen or, as illustrated in FIG. 2, formed in a collar 41. Second annular space 36 allows the slurry to by-pass the sand bridge 20 and the flow path through annular space 36 is illustrated with arrows 40.

FIG. 2 also illustrates a feature of the invention designed to ensure that the reentry of the slurry into the wellbore occurs at an optimal location in the wellbore. In FIG. 2 for example the aperture 48 adjacent entry aperture 34 is also surrounded by highly permeable formation 15. In order to prevent the slurry from reentering the annulus 16 in this continued area of high permeability, aperture 48 has a reduced inner diameter. In the preferred embodiment, the inner diameter of the aperture 48 is reduced with an insert 43 in order to discourage the flow of slurry back into the annulus 16 via aperture 48. Instead, the flow of slurry is encouraged to continue to the next aperture 49 as illustrated by arrows 40. Aperture 49 is constructed and arranged with a larger inner diameter. Consequently, as the flow of slurry reaches the next aperture 49, the slurry will reenter the annulus 16 where the formation of a gravel pack in the annulus will continue. By utilizing other apparatus 100 in the string of wellbore, additional sand bridges can be avoided in a similar manner. Since the alternative pathway provided by the second annular space 36 is larger than conventional shunt tubes, the apparatus 100 is able to carry more slurry at a faster rate to form a gravel pack more rapidly.

Figure 5:
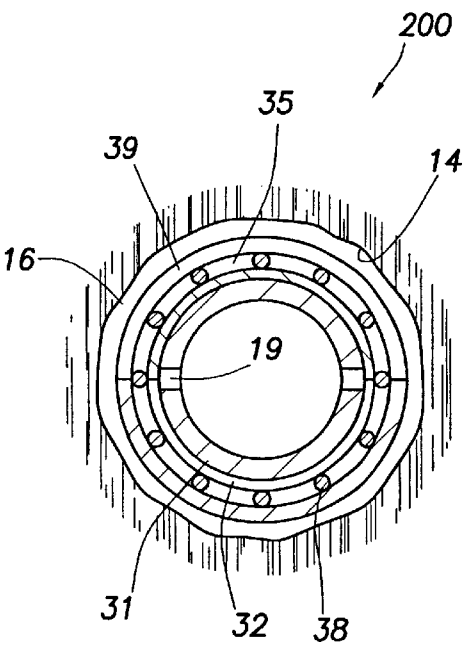
FIG. 5 is a cross-sectional view of an embodiment of the invention taken along line 5—5 of FIG. 4.
Figure 4:
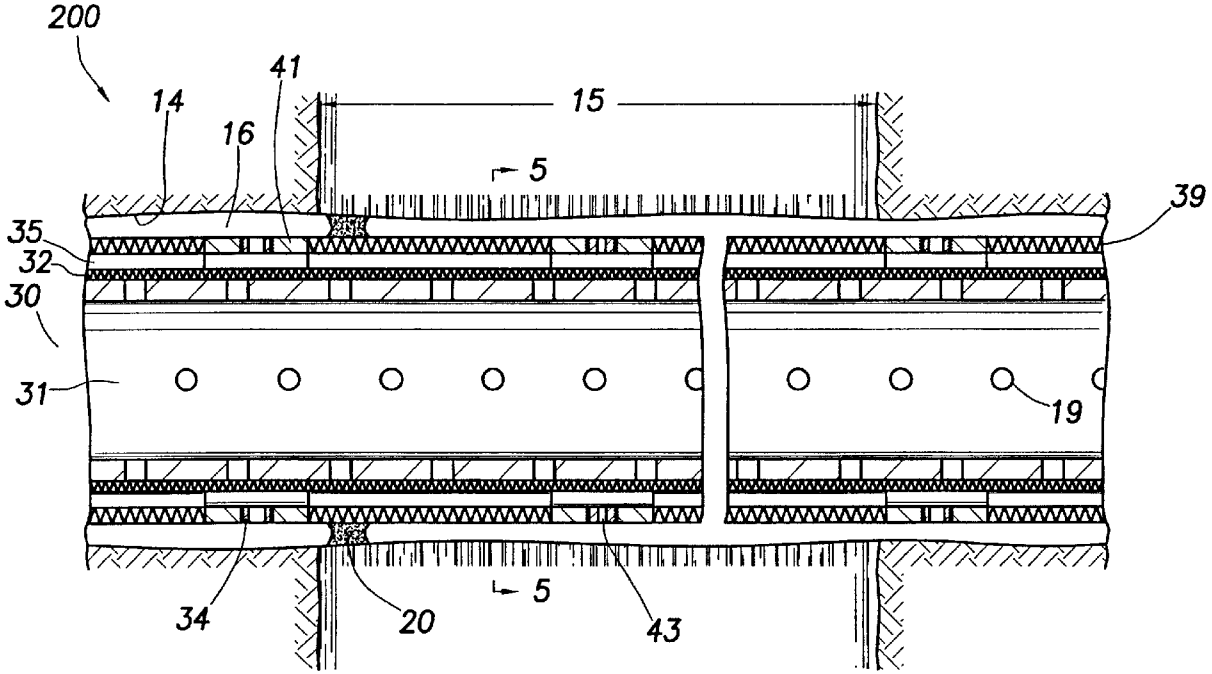
FIG. 4 is a side view of an embodiment of the present invention disposed in a wellbore.

While FIGS. 2 and 3 show one embodiment of the invention, the invention may also be practiced in alternative embodiments such as the one shown in FIG. 4. FIG. 4 is a side view of an apparatus 200 of the present invention disposed in a wellbore and FIG. 5 is a cross-sectional view of the apparatus taken along line 5—5 of FIG. 4. The apparatus 200 has a perforated base pipe 31 with perforations 19, a first wire wrap 32 disposed directly around the base pipe 31 with no annular space therebetween, and a second wire wrap 39 disposed around the first wire wrap 32, and separated therefrom by a first set of spacers 38 (FIG. 5) to form an annular space 35. In this embodiment, annular space 35 forms an alternative pathway for slurry to travel in the apparatus. Another alternative embodiment includes a perforated base pipe 31 that is slotted or manufactured with openings that act to filter particles. A wire wrap 32 disposed around the perforated base pipe 31 and separated by first set of spacers 38 to form an annular space 35 for the alternative pathway.

Figure 6:
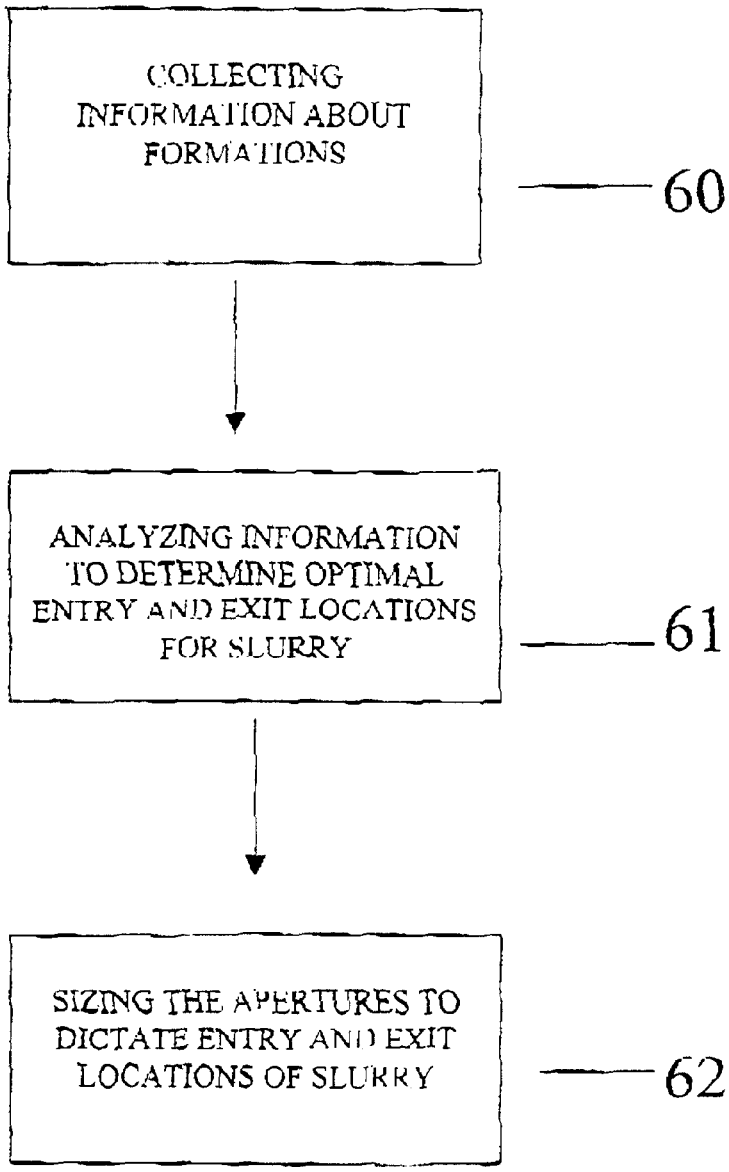
FIG. 6 is a flow chart illustrating a method of the current invention.

FIG. 6 is a flow chart illustrating a method of utilizing the current invention. Initially, information about the formations surrounding the wellbore is collected 60. The information is then analyzed 61 to determine the optimal entry and exit locations for slurry. The apparatus arrives at the well site with numerous apertures 34 prefabricated therein. Inserts 43 having various inner diameters are also supplied. The inserts 43 are also manufactured from erosion resistant materials such as tungsten carbide or ceramic and made to fit the apertures 34. Before the wellscreen 30 is inserted into the wellbore, the apertures are pre-sized 62 using inserts to determine the optimum entry and exist points for the slurry based upon the location of highly permeable portions of formations surrounding the wellbore. If permeable formations exist, apertures 34 are sized by placing inserts 43 to decrease the diameter of the aperture so as to limit the amount of slurry reentering the annulus 16. The apertures 34 can also receive insert that is blocked, thereby completely sealing the aperture to the flow of material therethrough. Further, if an abrasive sand packing procedure will be utilized or if the particles encountered will be highly abrasive, erosion resistant inserts 43 are added to minimize the erosion of the apertures 34. The erosive resistant inserts 43 may be made of materials such as ceramic or tungsten carbide. The embodiment allows for more accurate control of when, where and how much of the slurry reenters the annulus 16 from the alternative pathway.

While foregoing is directed to the preferred embodiment of the present invention, other and further embodiments of the invention may be devised without departing from the basic scope thereof, and the scope thereof is determined by the claims that follow. For example, the apparatus can be used in any wellbore where a portion of the wellbore is to be by-passed by a slurry of particulate matter. One example includes a water-bearing formation located between two hydrocarbon-bearing formations along a wellbore. By utilizing the apparatus according to the invention, the water-bearing formation can be isolated and by-passed by a slurry of gravel.

What is claimed is:

1. An apparatus for redirecting a particulate matter slurry, comprising:

a wellscreen comprising:

a perforated base pipe;

a wire wrap disposed around said perforated base pipe;

an annular space formed between said wire wrap and said perforated base pipe;

a first set of apertures at a first end of said wellscreen, wherein the first set of apertures comprises a first particulate matter slurry pathway connecting an exterior of said wire wrap to said annular space; and a second set of apertures at a second end of said wellscreen, wherein the second set of apertures comprises a second particulate matter slurry pathway connecting an exterior of said wire wrap to said annular space, and wherein the first and second set of apertures are circumferentially spaced around the entire wellscreen.

2. The apparatus of claim 1, wherein the first pathway is connected to the second pathway.

3. The apparatus of claim 1, wherein the first set of apertures is located in a first collar disposed within the wellscreen.

4. The apparatus of claim 3, wherein the second set of apertures is located in a second collar disposed within the wellscreen.

5. An apparatus for redirecting a particulate matter slurry, comprising:

a wellscreen having one or more sections of wellscreens, each section of wellscreen comprising:

a first wire wrap formed in a substantially tubular shape;

a second wire wrap disposed around said first wire wrap;

an annular space formed between said first and said second wire wraps;

a first set of apertures at a first end of said wellscreen, wherein the first set of apertures comprises a first particulate matter slurry pathway connecting an exterior of said second wire wrap to said annular space; and a second set of apertures at a second end of said wellscreen, wherein the second set of apertures comprises a second particulate matter slurry pathway connecting an exterior of said second wire wrap to said annular space.

6. The apparatus of claim 5, wherein the first pathway is connected to the second pathway.

7. The apparatus of claim 5, wherein the first set of apertures and the second set of apertures are disposed in collars disposed between one or more sections of the wellscreen.

8. An apparatus for redirecting a particulate matter slurry comprising:

a wellscreen comprising:

a perforated base pipe;

a first wire wrap disposed around said perforated base pipe;

a first annular space formed between said perforated base pipe and said first wire wrap;

a second wire wrap disposed around said first wire wrap;

a second annular space formed between said first and said second wire wraps;

a first set of apertures at a first end of said wellscreen, wherein the first set of apertures comprises a first particulate matter slurry pathway connecting an exterior of said second wire wrap to said second annular space; and a second set of apertures at a second end of said wellscreen, wherein the second set of apertures comprises a second particulate matter slurry pathway connecting an exterior of said second wire wrap to said second annular space.

9. The apparatus of claim 8, wherein the first pathway is connected to the second pathway.

10. An apparatus for redirecting a particulate matter slurry, comprising:

a wellscreen comprising one or more portions of wellscreens disposed adjacent to each other, each portion of wellscreen comprising:

a perforated base pipe having an outer surface;

a first set of spacers coupled on said outer surface of said perforated base pipe;

a first wire wrap coupled to said first set of spacers, thereby forming a first annular space with said perforated base pipe;

a second set of spacers coupled to an outer surface of said first wire wrap;

a second wire wrap coupled to the second set of spacers, thereby forming a second annular space between said first and said second wire wraps;

a first set of apertures at a first end of said wellscreen, wherein the first set of apertures comprises a first particulate matter slurry pathway connecting an exterior of said second wire wrap to said second annular space; and a second set of apertures at a second end of said wellscreen, wherein the second set of apertures comprises a second particulate matter slurry pathway connecting an exterior of said second wire wrap to said second annular space.

11. The apparatus of claim 10, wherein the first and second set of apertures are formed in collars separating adjacent portions of the wellscreen.

12. A method for redirecting a slurry of sand in a wellscreen, comprising:

providing a wellscreen in a wellbore, said wellscreen having a perforated base pipe, at least one annular space between said perforated base pipe and a wire wrap disposed around the perforated base pipe, a first set of apertures formed through a first end of the wire wrap, and a second set of apertures formed through a second end of the wire wrap, wherein the first and second set of apertures are circumferentially spaced around the entire wellscreen; and directing slurry in an annulus formed between a wellbore and an exterior of said wellscreen to enter said at least one annular space through the first set of apertures and to exit said at least one annular space through the second set of apertures.

* * * * *